US005842570A

United States Patent [19]

Turnbull

[11] Patent Number: 5,842,570

[45] Date of Patent: Dec. 1, 1998

[54] HANGING FILE STORAGE BOX

[75] Inventor: Guy A. Turnbull, Barrington, Ill.

[73] Assignee: Acco Brands, Inc., Lincolnshire, Ill.

[21] Appl. No.: 883,041

[22] Filed: Jun. 26, 1997

[51] Int. Cl.[6] ..... B42F 15/00

[52] U.S. Cl. ..... 206/425; 312/184

[58] Field of Search ..... 206/425, 214, 206/215; 312/183, 184; 229/164

[56] References Cited

U.S. PATENT DOCUMENTS

| | | | |
|---|---|---|---|
| 3,456,994 | 7/1969 | Sullivan . | |
| 3,614,185 | 10/1971 | Splan . | |
| 3,938,870 | 2/1976 | Guest et al. . | |
| 4,330,050 | 5/1982 | Sangster et al. | 206/425 X |
| 5,190,152 | 3/1993 | Smith et al. . | |
| 5,193,701 | 3/1993 | Bush et al. . | |
| 5,395,049 | 3/1995 | Huhn | 206/425 X |
| 5,494,161 | 2/1996 | Herbst . | |

FOREIGN PATENT DOCUMENTS

| | | |
|---|---|---|
| 514438 | 10/1952 | Belgium . |
| 977814 | 11/1975 | Canada . |
| 220505 | 4/1942 | Czechoslovakia . |
| 0 014 667 | 8/1980 | European Pat. Off. . |
| 54112 | 11/1947 | France . |
| 2-274598 | 11/1990 | Japan . |
| 446769 | 5/1936 | United Kingdom . |
| 1397129 | 6/1995 | United Kingdom . |

*Primary Examiner*—Jacob K. Ackun
*Attorney, Agent, or Firm*—Pennie & Edmonds LLP

[57] ABSTRACT

A hanging file box having opposed side walls with folded over flaps extending downwardly from their upper ends and a channel member secured to the upper end of each opposed side walls for supporting opposite ends of a plurality of hanging file storage members.

8 Claims, 5 Drawing Sheets

HANGING FILE STORAGE BOX

BACKGROUND OF THE INVENTION

Hanging file storage boxes are known. Two opposed side walls of the box are used to support hanging file folders which extend between the side walls. A plurality of such folders is usually provided with each one capable of containing documents. Typically, the boxes are constructed of laminated paperboard having an internal fluted or corrugated paperboard to which outside paperboard liners are glued on each side. For properly supporting the hanging folders, and to permit their sliding movement with respect to each other, channel support members are attached to supporting side walls. These channel members include a ledge on which the file folders hang.

Prior art hanging file storage box constructions are disclosed, for example U.S. Pat. Nos. 5,193,701 to Bush et al. and 5,494,161 to Herbst. In each of the constructions disclosed in these patents, the channel members are supported on side walls having a single wall thickness. In the '701 patent the channel members are attached directly to the outer, single thickness side walls of the box, while in the '161 patent, separate internal single walled panels are formed for supporting the channel members. The single wall thickness provided for supporting the channel members has been found to permit twisting of the channel members when a number of heavily loaded hanging file folders are supported on the channel members. This twisting tends to distort the shape of the box, and in particular, the vertical orientation of the side walls. This, in turn, can adversely affect the stacking capability of the box, since structural vertical strength is lost when the walls do not extend vertically.

Furthermore, prior box constructions are typically made with the side walls of different height so that the channel members can be positioned below the upper edges of box. This decreases the stacking capability of the box since only two side walls rather than four are available for supporting boxes stacked on top. In the box construction of the '161 patent, this problem is avoided to the extent that separate internal panel members are provided. In the construction of the '701 patent, corner posts are provided for vertical stability of the side walls.

SUMMARY OF THE PRESENT INVENTION

In accordance with the teachings of the present invention, the storage box is provided with opposed side walls for supporting the channel members. These side walls are provided with flaps at their upper ends. The flaps are folded over so as to provide a double thickness along the upper ends of the side walls. A channel member is mounted on each of the folded over upper ends of the side walls.

The dimensions of the side walls of the box are such that with channel members located on the two opposed side walls, the upper surfaces along each of the four side walls are spaced equally above the bottom of the box and thus level with each other. Preferably, the remaining two side walls of the box are of double thickness commensurate with that of folded over upper ends of the side walls used for supporting the channel members.

The channel members themselves each have an upper U-shaped section for engagement over the upper ends of the opposed supporting side walls. They extend vertically downwardly into the interior of the box the same distance as the flaps so as to be in full engagement with the side walls in the area of the flaps. The channel members have an internal ledge section for supporting the hanging file folders and a tail portion extending below the ledge for stabilizing the channel members on the side walls of the box.

DETAILED DESCRIPTION OF THE INVENTION

Figure 1:
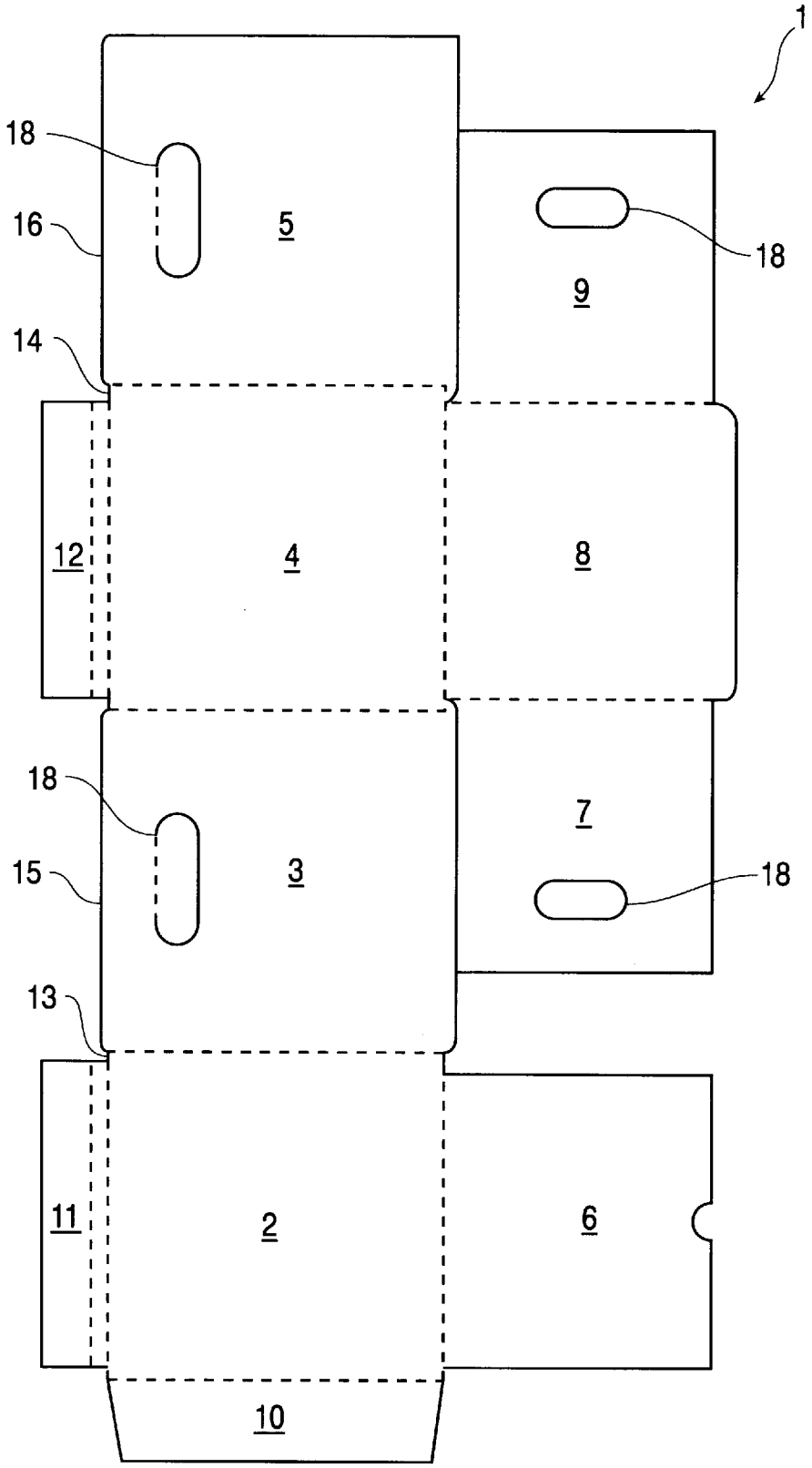
FIG. 1 is a plan view of the storage box blank before assembly into a box shape.

The laminated fluted paperboard blank 1 from which the storage box is constructed is shown to scale in FIG. 1. It is comprised of a number of sections 2–12. These sections define the different parts of the assembled box and are separated from each other by fold lines and cut lines. In FIG. 1 the fold lines are represented by the dash lines and the cut lines by solid lines between the sections.

Figure 3:
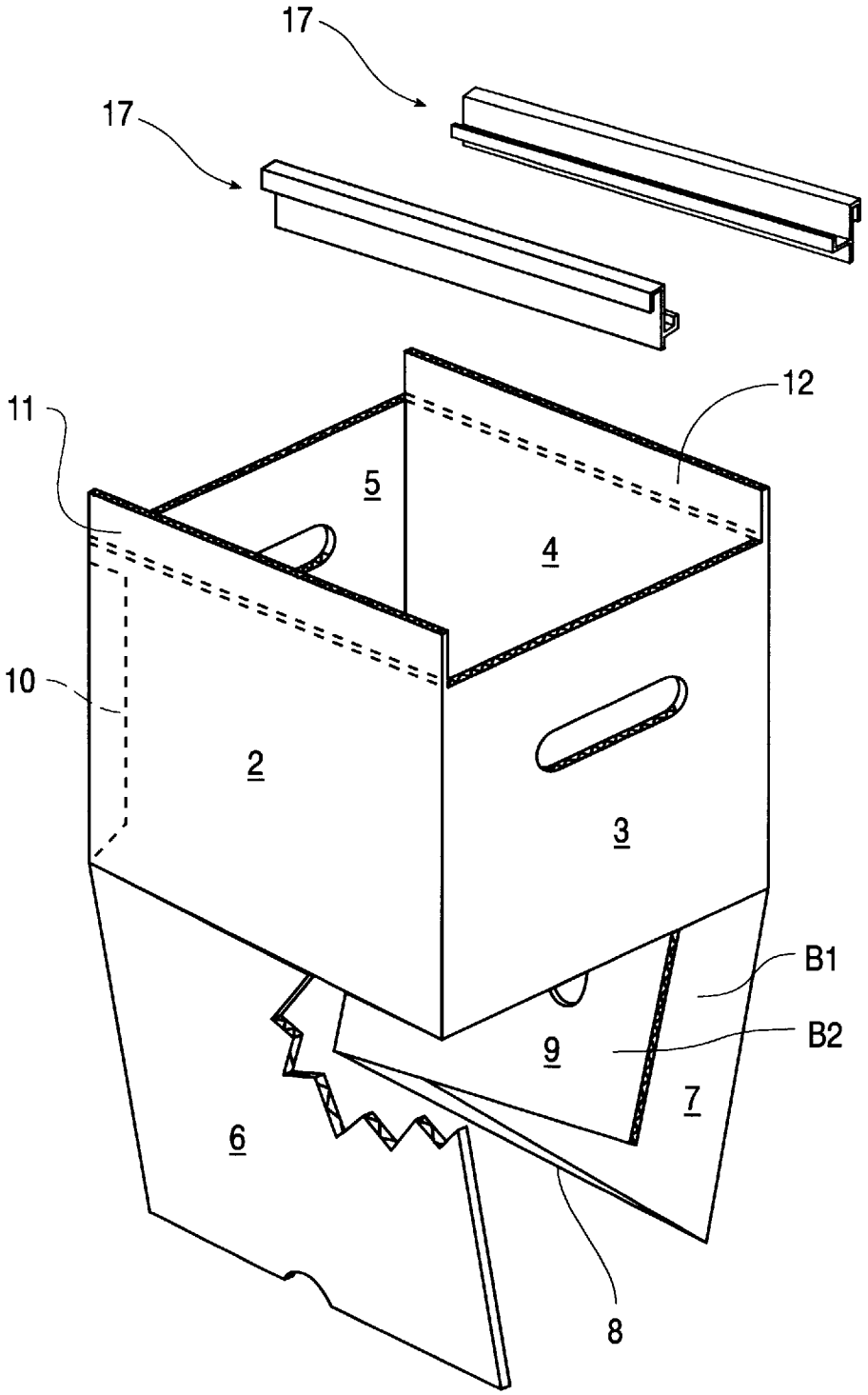
FIG. 3 is a perspective view of the partially erected and assembled box.
Figure 4:
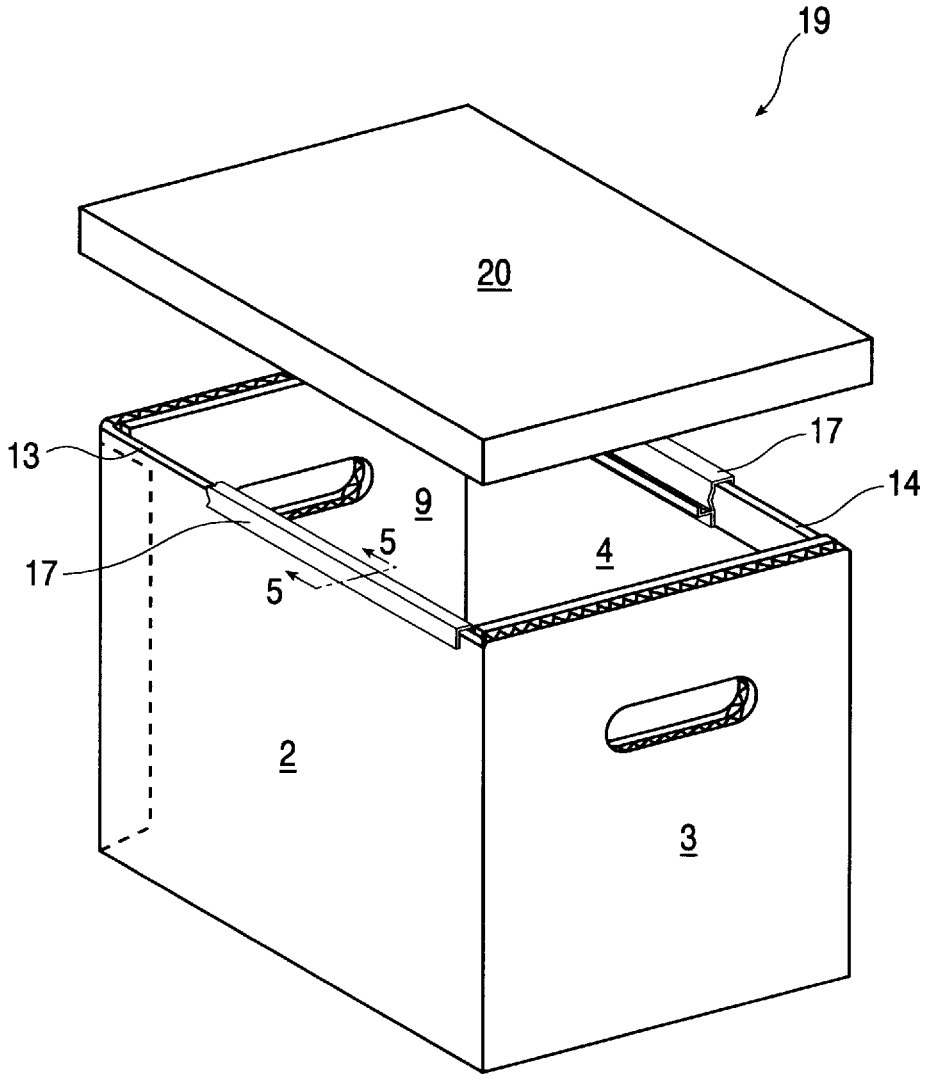
FIG. 4 is a perspective view of the completely assembled box, showing the lid removed.

By appropriately folding the various sections 2–12, the box configuration of FIGS. 3 and 4 is attained. In particular, the blank is first squared up, as shown in FIG. 3, with the sections 3 and 5 opposing each other to define first and second opposed side walls. At the same time, the sections 2 and 4 are oriented to oppose each other and define third and fourth opposed side walls. These side walls all extend upwardly from what will become the bottom of the box and together will define the box interior. Next, the section 6 is folded up through the bottom opening provided by the sections 2, 3, 4 and 5, until it contacts the section 2. The sections 7 and 9 are folded over section 8 and the three sections are folded upwardly into the bottom opening until the section 8 is disposed along the bottom edge of each of the sections 2, 3, 4 and 5, so as to define the bottom of the box. Next, the sections 7 and 9 are folded upwardly into overlapping relation with the sections 3 and 5 defining the first and second opposed side walls. The section 6 is then folded downwardly on top of the section 8 to provide a double walled thickness for the bottom of the box. The section 10 of the blank is overlapped on section 5 and adhesively connected to this section immediately after the die cutting of the blank. In this way, section 10 will be covered and out of harms way. Finally, the sections 11 and 12 are folded downwardly into the interior of the box to define internal flaps at the upper ends 13 and 14 of the opposed side walls defined by the associated sections 2 and 4.

Figure 5:
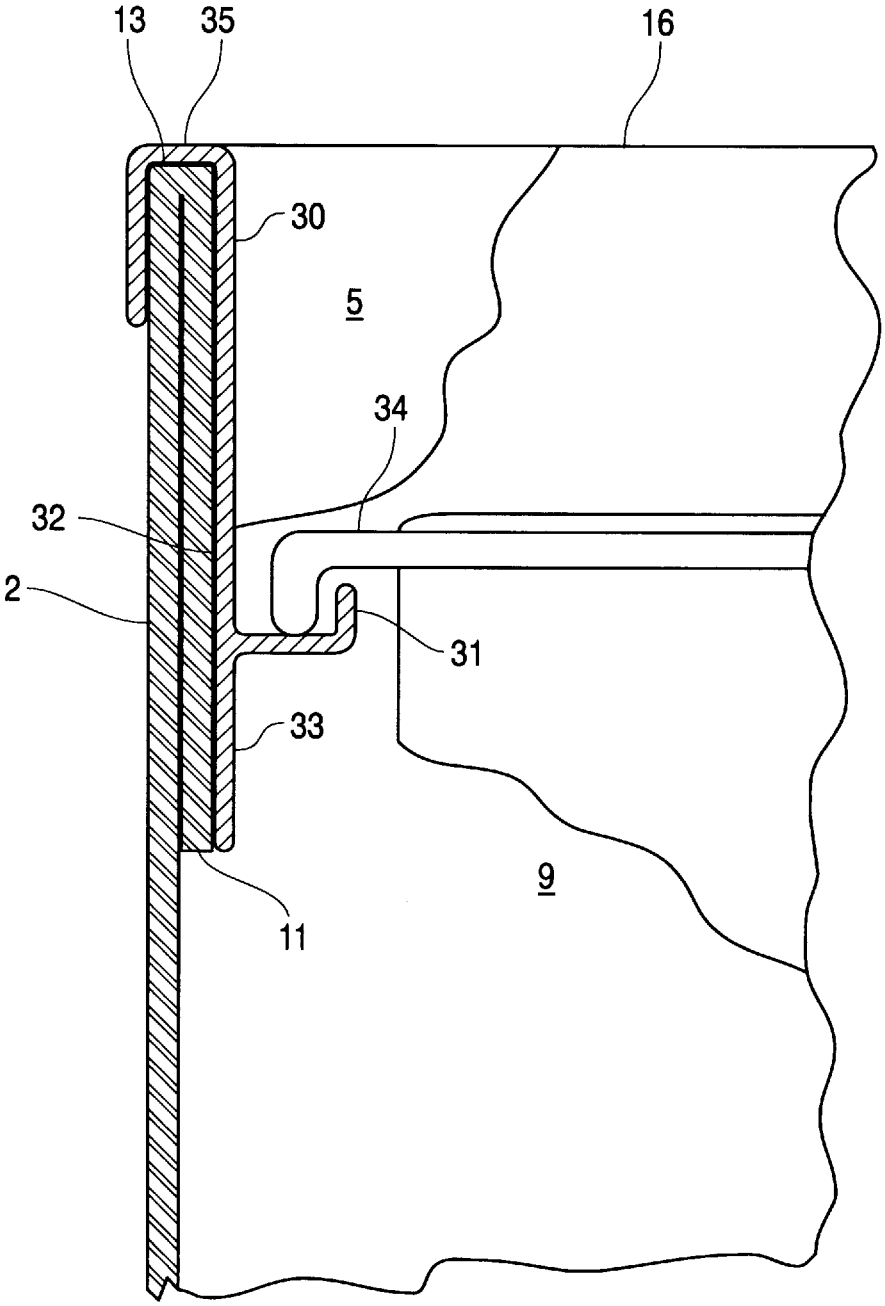
FIG. 5 is an enlarge cross-sectional view taken along line 5—5 of FIG. 4.

As shown FIGS. 1 and 5, the upper ends 15 and 16 of the side walls defined by the sections 3 and 5 are at a higher level than the upper ends 13 and 14 of the side walls defined by the sections 2 and 4. The unlevelness of the upper ends 13, 14, 15 and 16 provides vertical space for the channel members 17 on the sections 2 and 4 defining the third and fourth opposed side walls of the box, as further discussed below.

The sections 3, 7 and 5, 9, forming the first and second opposed double side walls of the box, are each provided with hand openings 18. These openings are aligned with each other to permit ready access for the user to pick up the box.

Finally, the flutes or corrugation of the inner paperboard run in a direction so that all of the sections 2, 3, 4 and 5 have these flutes running vertically when defining the side walls of the box. This adds to the vertical stacking strength of the box.

Figure 2:
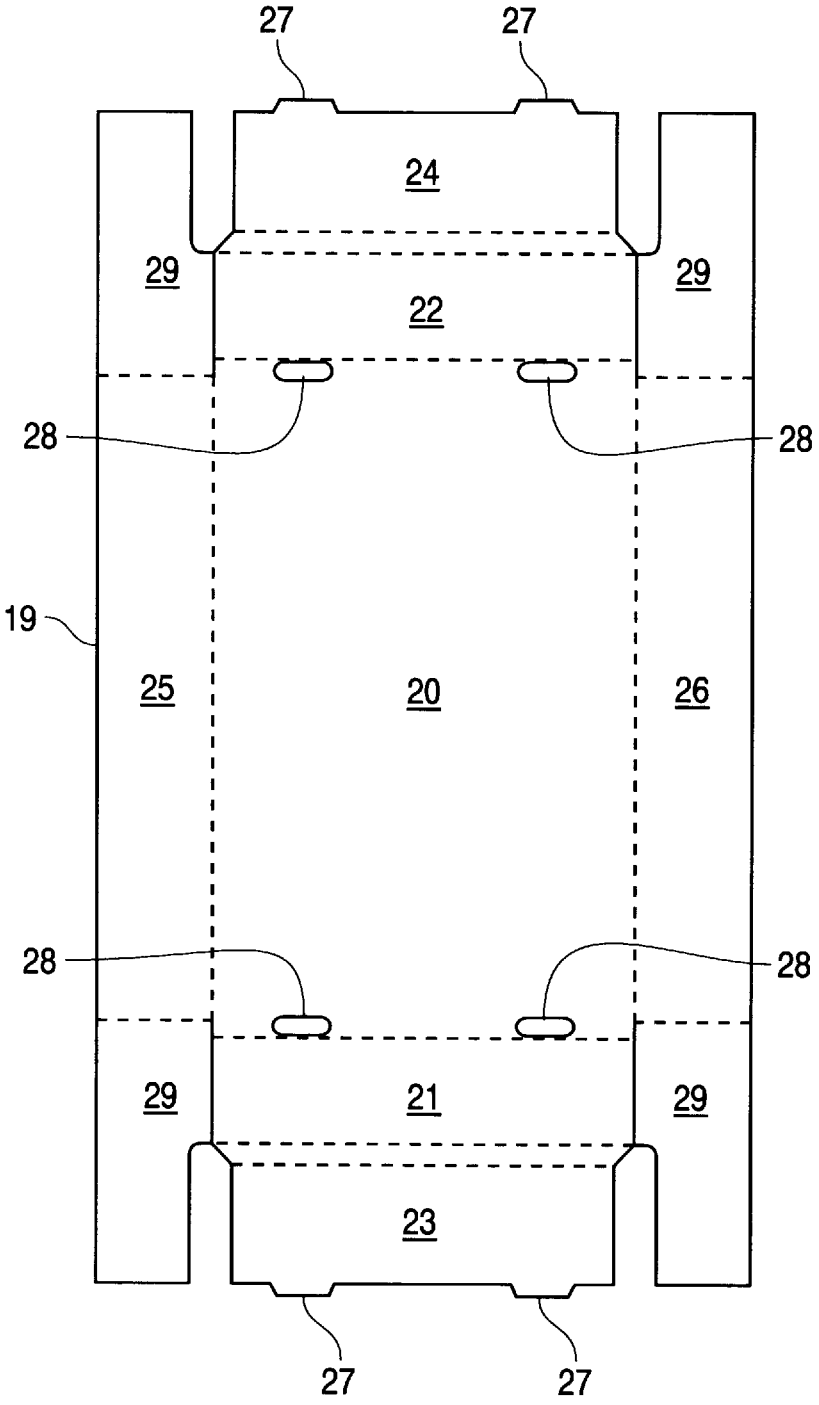
FIG. 2 is a plan view of the separate lid of the box, before folding into a lid shape.

The lid 19 for the box is shown to scale in FIG. 2. It section 20 forming the top of the lid. At either end of section 20 is an end section 21, 22 and a flap 23, 24. Side sections 25, 26 extend along the remaining sides of the body section 20. In assembly, the flaps 23 and 24 folded over the ends 21 and 22. The flaps 23 and 24 contain tabs 27 which are accommodated in openings 28 in the body section of the lid. After this folding operation, the sides 25, 26 are folded over with their end portions 29, having already been tucked between sections 21, 23 and 22, 24.

The channel members 17, as shown in FIGS. 4 and 5, include an upper inverted U-shaped section 30, a ledge section 31 spaced below the U-shaped section 30, and an engaging section 32. The engaging section extends between the upper section 30 and the ledge section 31 and has a tail portion 33 extending below the ledge section 31.

As shown in FIG. 5, the engaging section 32 of the channel member on the side wall defined by the section 2 will engage against the associated flap 11. In accordance with the invention, the distance the flap extends downwardly into the interior of the box is equal to the distance of the engaging section 32 of the channel member extends into the interior. In the presently preferred box construction, the interior of the box has a depth of 10 ½ inches and the flap extends 1¾ inches into the interior. As also shown in FIG. 5, the combined thickness of the section 2 and folded section 11 is equal to the spacing between the opposed walls of the upper inverted U-shaped section 30 of the channel member.

The construction of the box and channel members according to the present invention provides the advantage of strengthening and stabilizing the support of the channel members on the side walls and lessening their tendency to twist or tip under the weight of loaded hanging file folders. In this regard, one end 34 of such a file folder is shown in FIG. 5 as engaged in the ledge section 31 of the channel member.

Finally, as shown in FIGS. 4 and 5, the upper ends 15 and 16 of the sections 3 and 5 defining the near and far side walls, as shown in FIG. 4, are higher than the upper ends 13 and 14 of the sections 2 and 4. Similarly, the sections 7 and 9 are of the same height as the sections 3 and 5. This difference in height is equal to the thickness of the upper end 30 of the channel member. With this construction, the upwardly facing uppermost surface 35 of the upper end 30 of the channel member is spaced from the bottom of the box, as defined by the sections 6 and 8, by a distance equal to the spacing of the upper ends 15 and 16. Thus, the box provides a construction in which the upper ends of all side walls are effectively level for supporting the lid 19 and other boxes.

I claim:

1. A hanging file paperboard storage box comprising:

a) a bottom;

b) first and second opposed side walls extending upwardly from said bottom and having upper ends spaced above said bottom;

c) third and fourth opposed side walls extending upwardly from said bottom and extending between said first and second side walls to define therewith an interior of said box;

d) said third and fourth side walls each having an upper end spaced above said bottom and an associated folded over flap folded inwardly into the interior of said box and extending downwardly a predetermined distance from said upper end in overlapping contacting relation with the associated one of said third and fourth side walls;

e) a channel member secured to the upper end of each of said third and fourth side walls for supporting opposite ends of a plurality of hanging file storage members between said third and fourth side walls;

f) each of said channel members having an upper inverted U-shaped section, with opposed spaced walls, for engaging over the upper end of one of said third and fourth side walls, a ledge section spaced below said U-shaped section for supporting one end of each of said file storage members, and an engaging section disposed between said U-shaped section and said ledge section and extending into the interior of said box a distance about equal to said predetermined distance and engaging against the folded over flap of said one of the third and fourth side walls for holding the channel member in a generally vertical orientation in the interior of said box.

2. A hanging file storage box comprising:

a) a bottom;

b) first and second opposed side walls extending upwardly from said bottom and having upper ends spaced above said bottom;

c) third and fourth opposed side walls extending upwardly from said bottom and extending between said first and second side walls to define therewith an interior of said box;

d) said third and fourth side walls each having an upper end spaced above said bottom and an associated folded over flap folded inwardly into the interior of said box and extending downwardly a predetermined distance from said upper end in overlapping relation with the associated one of said third and fourth side walls;

e) a channel member secured to the upper end of each of said third and fourth side walls for supporting opposite ends of a plurality of hanging file storage members between said third and fourth side walls;

f) each of said channel members having an upper inverted U-shaped section, with opposed spaced walls, for engaging over the upper end of one of said third and fourth side walls, a ledge section spaced below said U-shaped section for supporting one end of each of said file storage members, and an engaging section disposed between said U-shaped section and said ledge section and including a tail portion extending beyond said ledge section, said engaging section extending into the interior of said box a distance about equal to said predetermined distance and engaging against the folded over flap of said one of the third and fourth side walls for holding the channel member in a generally vertical orientation in the interior of said box;

g) each of said third and fourth side walls and the associated overlapping flap having a predetermined thickness; and h) the opposed walls of the upper inverted U-shaped section of each channel member being spaced from each other by a distance equal to said predetermined thickness.

3. The storage box of claim 2 wherein:

a) each of said first and second side walls includes two wall sections extending between said bottom and the upper ends thereof and also extending between said third and fourth walls.

4. The storage box of claim 2 wherein the upper ends of said first and second side walls are spaced above the bottom of said box by a distance greater than the spacing of the upper ends of said third and fourth side walls above said bottom.

5. The storage box of claim 2 wherein the upper U-shaped sections of said channel members, when engaged over the upper ends of third and fourth side walls, defines an uppermost surface facing upwardly and spaced from the bottom of said box by a distance equal to the spacing of the upper ends of the first and second side walls above said bottom.

6. The storage box of claim 2 wherein:

a) said side walls have a height of between about 10 and 11 inches; and b) each of said flaps extends downwardly into the interior of said box by a predetermined distance of between about 1 ½ and 2 inches.

7. A hanging file storage box comprising:

a) a bottom;

b) first and second opposed side walls extending upwardly from said bottom and having upper ends spaced above said bottom;

c) third and fourth opposed side walls extending upwardly from said bottom and extending between said first and second side walls to define therewith an interior of said box;

d) said third and fourth side walls each having an upper end spaced above said bottom and an associated folded over flap extending downwardly from said upper end in overlapping relation therewith;

e) a channel member secured to the upper end of each of said third and fourth side walls for supporting opposite ends of a plurality of hanging file storage members between said third and fourth side walls;

f) each of said channel members having an upper inverted U-shaped section, with opposed spaced walls, for engaging over the upper end of one of said third and fourth side walls, a ledge section spaced below said U-shaped section for supporting one end of each of said file storage members, and an engaging section disposed between said U-shaped section and said ledge section for engaging against said one of the third and fourth side walls for holding the channel member in a generally vertical orientation in the interior of said box; and g) the upper U-shaped sections of said channel members, when engaged over the upper ends of third and fourth side walls, defining an uppermost surface facing upwardly and spaced from the bottom of said box by a distance equal to the spacing of the upper ends of the first and second side walls above said bottom.

8. The storage box of claim 7 wherein:

a) each of said first and second side walls includes two wall sections extending between said bottom and the upper ends thereof and also extending between said third and fourth walls.

* * * * *